US006273017B1

(12) United States Patent
Griffin

(10) Patent No.: US 6,273,017 B1
(45) Date of Patent: Aug. 14, 2001

(54) BOAT MOORING DEVICE

(76) Inventor: Gene E. Griffin, 2322 River Rd., Granbury, TX (US) 76048

( * ) Notice: Subject to any disclaimer, the term of this patent is extended or adjusted under 35 U.S.C. 154(b) by 0 days.

(21) Appl. No.: 09/496,791

(22) Filed: Feb. 2, 2000

Related U.S. Application Data

(60) Provisional application No. 60/123,796, filed on Mar. 3, 1999.

(51) Int. Cl.[7] ..... B63B 21/00

(52) U.S. Cl. ..... 114/230.25; 114/221 R

(58) Field of Search ..... 114/221 R, 230.1, 114/230.15, 230.2, 230.25

(56) References Cited

U.S. PATENT DOCUMENTS

| | | | | |
|---|---|---|---|---|
| 1,623,774 | | 4/1927 | Bell . | |
| 1,852,629 | * | 4/1932 | Sturges | 114/230.25 |
| 2,811,127 | | 10/1957 | Palsson . | |
| 3,224,404 | | 12/1965 | Jong . | |
| 3,677,597 | | 7/1972 | Stipek . | |
| 3,828,716 | | 8/1974 | Bernardi . | |
| 3,841,685 | | 10/1974 | Kolodziej . | |
| 3,861,346 | * | 1/1975 | Pina | 114/230.25 |
| 3,878,808 | | 4/1975 | Mock, Jr. . | |
| 3,918,385 | | 11/1975 | Wallace . | |
| 3,945,335 | | 3/1976 | Kratz . | |
| 3,993,013 | | 11/1976 | Nunziato et al. . | |
| 4,261,280 | | 4/1981 | Collic, Sr. . | |
| 4,519,643 | | 5/1985 | Harris . | |
| 4,557,214 | | 12/1985 | Molitor . | |
| 4,596,530 | | 6/1986 | McGlinn . | |
| 4,635,986 | | 1/1987 | Johns . | |
| 4,667,617 | | 5/1987 | Molitor . | |
| 4,708,083 | | 11/1987 | Billings . | |
| 5,088,449 | | 2/1992 | Lamb, Sr. et al. . | |
| 5,116,260 | | 5/1992 | UpChurch . | |
| 5,282,825 | | 2/1994 | Muck et al. . | |
| 5,398,634 | | 3/1995 | Eagan . | |
| 5,538,302 | | 7/1996 | Travis . | |
| 5,586,574 | | 12/1996 | Smith . | |
| 5,634,421 | | 6/1997 | Velarde . | |
| 5,699,748 | | 12/1997 | Linskey, Jr. et al. . | |
| 5,799,602 | | 9/1998 | Trillon . | |

* cited by examiner

*Primary Examiner*—Stephen Avila
(74) *Attorney, Agent, or Firm*—James E. Bradley; Bracewell & Patterson, L.L.P.

(57) ABSTRACT

A device for mooring a boat has an elongate handle with proximal and distal ends. The distal end has an eyelet. A flexible mooring line with a first end is joined to the eyelet and a second end is adapted to join to the boat. The line extends through the eyelet and about an exterior of the handle member to the proximal end to form a loop at the distal end. The size of the loop can be adjusted by feeding more or less of the line through the eyelet. A flexible retaining line is joined to the proximal end and adapted to join to the boat.

11 Claims, 1 Drawing Sheet

BOAT MOORING DEVICE

CROSS-REFERENCE TO RELATED APPLICATIONS

This application claims the benefits of provisional patent application Ser. No. 60/123,796, filed on Mar. 3, 1999, in the United States Patent & Trademark Office.

TECHNICAL FIELD

This invention relates to a boat mooring device. More particularly, this invention relates to a device for ready attachment and release of a boat to a securing object.

BACKGROUND OF THE INVENTION

Historically, there has been no easy means to moor a boat to a securing object, such as a tree stump or piling, especially if the securing object is near or below the surface of the water. Generally, a boat is moored by tying a rope around the securing object and anchoring that rope to a cleat or other mooring member on the boat. If the securing object is not directly adjacent to the boat and at approximately the same level as the boat, the user must either lay on the boat deck and reach out over the water or toss the rope as a lasso. This can be difficult when conditions are windy or waves cause the boat to bob, as is often the case in open water. Further, once the rope has been placed around the securing object, it must be tied. Tying the rope in windy or rough water conditions is difficult.

Several patents show devices to aid a user in mooring a boat. U.S. Pat. No. 5,586,514 depicts a device with a rope passed through the inside of an elongate handle. A loop is formed on one end by passing the rope through a smaller flexible tube. This allows the loop to remain open so the it can easily be used to snare a boat dock cleat, pole or other device when docking. The tubular handle is used to extend the user's reach, aiding in snaring the dock cleat. A loop is also formed on the other end of the handle to fit over the boat cleat. The loop used to snare the dock cleat is fixed and not adjustable, thus, it cannot be pulled tight around various sizes of stumps or pilings and is susceptible to slipping off.

Other devices, such as the one depicted in U.S. Pat. No. 4,519,643, have adjustable loops, but also employ many complicated sleeves and bushings to adjust the loop and extend the handle, all which increase expense and weight of the device. Still others, as depicted in U.S. Pat. No. 5,799,602 have a forked tray which holds the loop for placement over the securing object. Once over the securing object, the forked tray can be removed, allowing the loop to be tightened. This however, is limited by the distance between the thongs of the tray, as the forked tray must be able to fit over the securing object. Also if the securing object is beneath the water, the rope may tend to float off the object unless cinched tight. Finally, upon removal of the forked device, there is no provision to keep the boat spaced from the securing object.

Therefore, there is a need for a light weight, simple boat mooring device. The device should space the boat from the securing object and be able to accommodate various widths of securing objects. Further, the device should tighten about the securing device to secure the boat.

SUMMARY OF THE INVENTION

The present invention is drawn to a simple boat mooring device which can accommodate various sizes of securing objects. The device has an elongate handle member with proximal and distal ends. The distal end has an eyelet. A flexible mooring line has a first end joined to the eyelet, and a second end adapted to join to the boat. The line extends through the eyelet and about an exterior of the handle member to the proximal end to form a loop at the distal end. The size of the loop can be adjusted by feeding more or less of the line through the eyelet. A flexible retaining line is joined to the proximal end of the handle member and adapted to join to the boat to retain the handle member at the boat. Any tension on the mooring line due to movement of the boat passes only through the mooring line and not through the handle member or retaining line.

The retaining line and the second end of the mooring line each have a loop adapted to fit closely over a cleat on a boat. The mooring line is preferably non-buoyant and resilient, such that the loop tends to remain open and substantially in line with the handle member when supported at the eyelet. The mooring line comprises a first portion and a second portion, wherein the second portion is more flexible than the first portion.

DETAILED DESCRIPTION OF THE INVENTION

Figure 1:
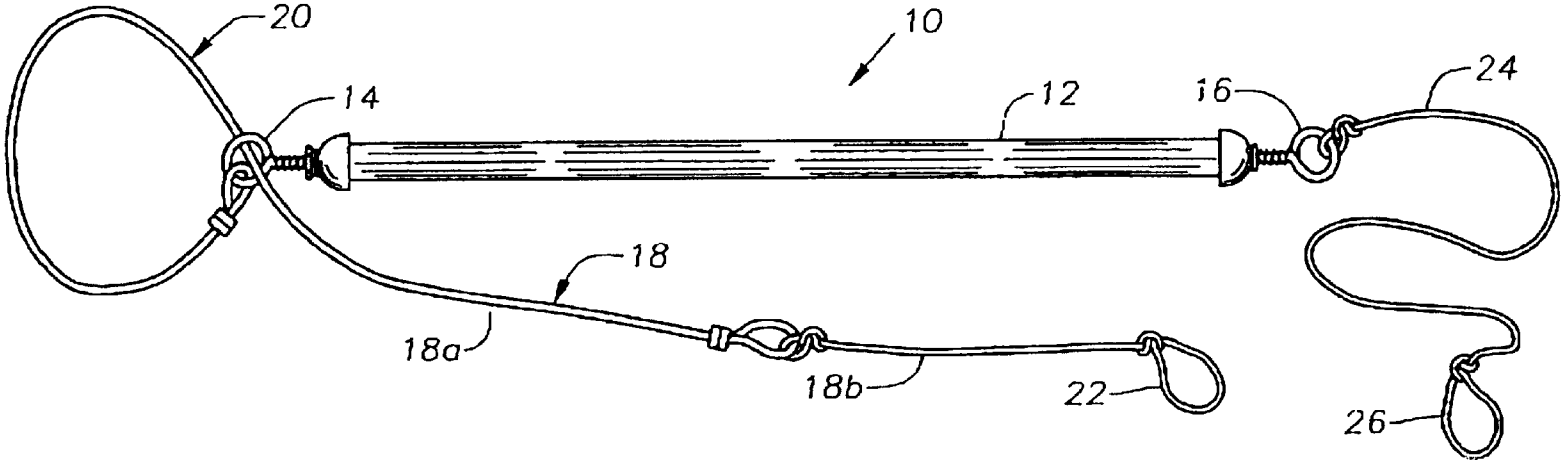
FIG. 1 is an elevation view of a boat mooring device constructed in accordance with this invention.

Referring first to FIG. 1, a boat mooring device 10 constructed in accordance with this invention generally has a handle member 12 with an first eyelet 14 at one end and a second eyelet 16 at the other. Eyelets 14, 16 are positioned along the same axis as the longitudinal axis of handle member 12. Handle member 12 is constructed of an inexpensive material such as PVC piping, other plastic, or wood and having a relatively high strength to weight ratio and constructed to float. It has been found that between three (3) and three and one half (3½) feet is a desirable length for handle member 12. To further reduce the weight of handle 12, it may be tubular. For ease of construction, eyelets 14, 16 can be conventional eye-bolts threaded into the ends of handle member 12. In one embodiment, handle member 12 is a length of standard PVC pipe with conventional PVC caps joined to either end. Eyelets 14, 16 are conventional eye-bolts retained in the caps with a nut.

A mooring line 18 has one end joined to first eyelet 14 and is passed back through first eyelet 14 to form a mooring loop 20. There is more than enough line 18 to allow mooring loop 20 to be enlarged to fit over a typical securing object 21 (FIG. 2), for example a stump or piling, and extend back along the exterior of handle member 12 to its other end. Preferably, the length is slightly longer than the length of handle member 12. Line 18 may be a wire rope, synthetic cord, or other material having a stiffness or resiliency such that mooring loop 20 tends to remain open and substantially in line with handle member 12 when supported at eyelet 14. Additionally, it is desirable that line 18 be non-buoyant, so that when placed in the water it can readily be guided around submerged objects and once secured does not tend to float off.

The free end of mooring line 18 has a mooring cleat loop 22. Line 18 may be constructed in parts 18*a*, 18*b* with the part 18*b* having mooring cleat loop 22 constructed from a more flexible material, such as polypropylene rope, than the part 18*a* having the mooring loop 20. The two part line 18*a*, 18*b* facilitates handling and anchoring to cleat 30.

Figure 2:
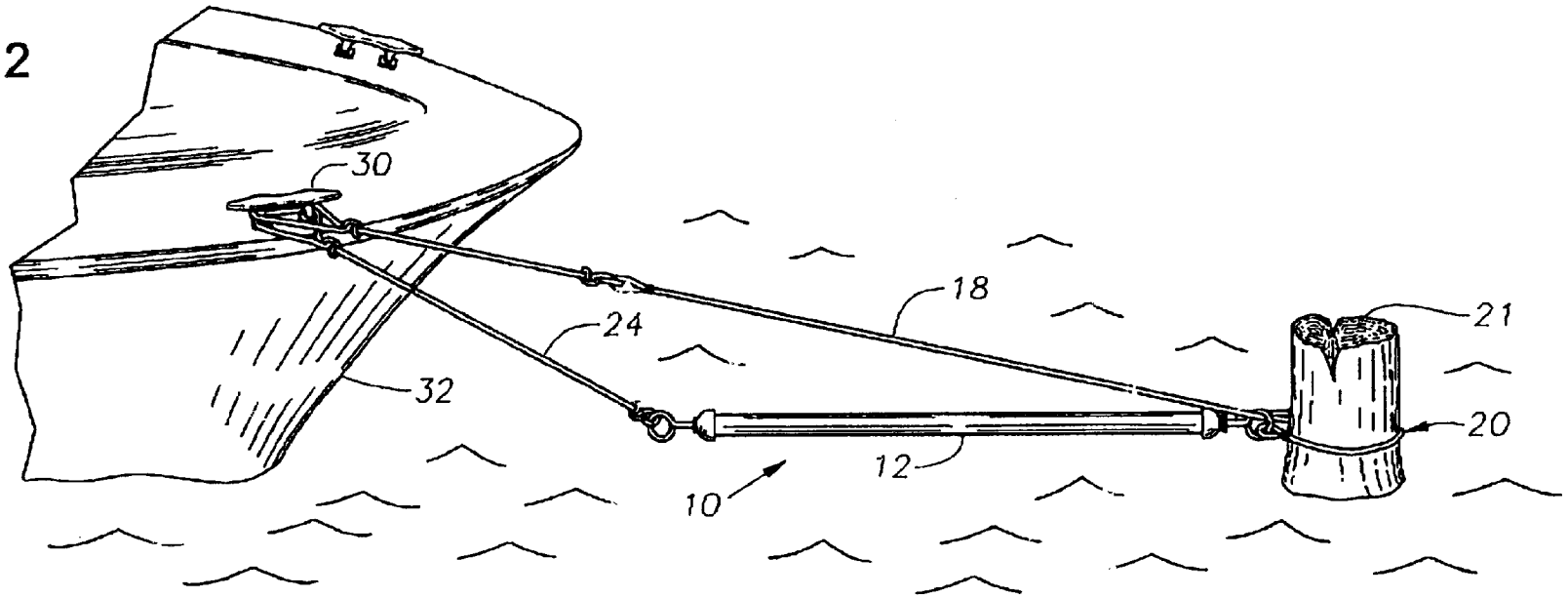
FIG. 2 is an elevation view of the boat mooring device of FIG. 1, shown in use securing a boat.

Second eyelet 16 has a retaining line 24 joined thereto; wherein retaining line 24 has a small retaining cleat loop 26 similar to mooring cleat loop 22 at its free end. Cleat loops 22, 26 are sized to fit closely over a conventional marine cleat 30 (FIG. 2). Retaining line 24 is used to retain the proximal end of handle 12 with the boat, not to moor the boat. Retaining line 24 is a more flexible material than mooring line 18, such as polypropylene rope, to facilitate handling and securing to cleat 30.

In use, a user on boat 32 grasps the boat mooring device 10 by handle member 12 and line 18. Line 18 is then fed through eyelet 14 to enlarge mooring loop 20, and mooring loop 20 is placed over securing object 21. If object 21 is larger than the largest loop 20 which can be made by line 18, additional rope or line can be secured to mooring cleat loop 22. If securing object 21 is beneath the water line, line 18 will sink to facilitate placement of the mooring loop 20. The user then draws line 18 inward to tighten mooring loop 20 around the securing object 21 and pulls boat 32 towards object 21. Retaining cleat loop 26 and mooring cleat loop 22 are then each placed over cleat 30. Preferably, lines 18 and 24 are secured so that the length of mooring line 18 will be shorter than the length of handle 12, plus retaining line 24. A user can compensate for slack in line 18, or draw boat 32 closer to securing object 21 by wrapping line 18*b* around the cleat 30. If loop 20 becomes loose and object 21 is beneath the water line, loop 20 will not float off.

As currents and wind move boat 32 away from securing object 21, the tension force is applied through mooring line 18, not through handle 12 and retaining line 24. Retaining line 24 only serves to allow ready access of a user to the proximal end of handle 12. Optionally, the user may not place retaining cleat loop 26 over cleat 30 and allow the handle to float freely in the water. Tension forces do not pass through handle 12. Further, handle 12 does not serve as a fender or standoff, if the boat moves toward securing object 21. Handle 12 does not receive compression forces.

To remove the boat mooring device 10, the user releases retaining cleat loop 26 and mooring cleat loop 22 from the boat cleat 30, and handle member 12 is retrieved by pulling in retaining line 24. If retaining cleat loop 26 was not placed over cleat 30, the user can pull boat 32 closer to securing object 21 by pulling line 18, and then retrieve handle 12. The user then feeds line 18 through eyelet 14 to enlarge the mooring loop 20, and mooring loop 20 is lifted from securing object 21. The entire device 10 can be stored on board.

To store boat mooring device 10, line 18 is drawn in towards line 24 and each line wrapped around handle 12. Line 18 and line 24 wrapped around handle 12 can be secured with a rubber band or quick release strap, thus allowing boat mooring device 10 to be stored conveniently in narrow storage areas common on water craft.

The boat mooring device of this invention has many advantages. It is simple and light weight, making it both inexpensive to manufacture and maneuverable and easy to use. The adjustable loop can accommodate many sizes of securing objects, including small branches and large post pilings or tree trunk stumps. If the supplied line is not enough to capture the piling, more line can be easily added to increase the size of the loop. Once over the securing object, the loop can be secured, thus preventing the loop from slipping off. If the loop is loose about the securing object, the loop will not tend to float off the securing object because it is not buoyant. The tensile forces of the boat pulling against the securing object are carried in the mooring line.

While this invention has been shown in only one of its forms, it should be apparent to those skilled in the art that it is not so limited, but is susceptible to various changes without departing from the scope of the invention.

What is claimed is:

1. A device for mooring a boat, comprising:

an elongate rigid handle member having a proximal end and a distal end, the distal end having an eyelet;

a flexible mooring line having a first end secured at the distal end of the handle and a second end adapted to join to the boat, the mooring line extending through the eyelet and along an exterior of the handle member to the proximal end to form a loop at the distal end for placing over a securing object, wherein a size of the loop can be adjusted by feeding more or less of the line through the eyelet; and wherein the mooring line comprises a first portion that forms the loop for fitting around a securing object and a second portion adapted to join to the boat, wherein the second portion is more flexible than the first portion and the first portion is more resilient than the second portion to readily form a loop.

2. The device of claim 1 wherein the first portion of the mooring line is non-buoyant.

3. The device of claim 1 wherein the first portion of the mooring line is wire rope.

4. The device of claim 1 wherein the first end of the mooring line is secured to the eyelet.

5. An apparatus for securing a boat to an object comprising:

an elongate handle member having an eyelet at a first end;

a mooring line having a first portion joined to the first end of the handle member and a second portion adapted to join to the boat, the mooring line extending through the eyelet and along the exterior of the handle member to a second end of the handle member to form a loop at the first end for placing over a securing object, wherein a diameter of the loop can be adjusted by feeding more or less of the line through the eyelet, and wherein the first portion is more resilient than the second portion and the second portion is more flexible than the first portion; and a retaining line joined to the second end of the handle member adapted to join to the boat.

6. The apparatus of claim 5 wherein an end of the retaining line and the second portion of the mooring line each have a retaining loop, and a length of the mooring line from the retaining loop on the mooring line to the eyelet is less than a sum of the length of the retaining line from the retaining loop on the retaining line to the second end of the handle plus a length of the handle.

7. The apparatus of claim 5 wherein the first portion of the mooring line is non-buoyant.

8. The apparatus of claim 5 wherein the first portion of the mooring line is wire rope.

9. A method of mooring a boat to a securing object, comprising the steps of:

(a) providing an elongate handle member with an eyelet, a mooring line having a first end joined to a distal end of the handle member and a second end passing through the eyelet to form a loop and extending along side the handle member, and attaching a first end of a retaining line to a proximal end of the handle member;

(b) grasping the proximal end of the handle and placing the loop over the securing object;

(c) pulling the second end of the mooring line to cinch the loop around the securing object;

(d) securing the second end of the mooring line to the boat; and (e) securing a second end of the retaining line to the boat, with enough slack in the retaining line so that movement of the boat away from the securing object applies tension to the mooring line and not through the handle.

10. The method of claim 9 further comprising the steps of:

providing a loop on the second end of the mooring line and a loop on the second end of the retaining line; and wherein a length of the mooring line from the loop on the mooring line to the eyelet is less than a sum of the length of the retaining line from the loop on the retaining line to the proximal end of the handle, plus a length of the handle.

11. The method of claim 9 wherein in step (c) one hand of a user continues to grasp the handle while another hand of the user pulls the second end of the mooring line.

* * * * *